US006554001B1

(12) United States Patent
Godshaw

(10) Patent No.: US 6,554,001 B1
(45) Date of Patent: Apr. 29, 2003

(54) PORTABLE VANITY CASE

(75) Inventor: Donald E. Godshaw, Evanston, IL (US)

(73) Assignee: Travel Caddy Inc., Des Plaines, IL (US)

( * ) Notice: Subject to any disclaimer, the term of this patent is extended or adjusted under 35 U.S.C. 154(b) by 0 days.

(21) Appl. No.: 09/960,178

(22) Filed: Sep. 21, 2001

Related U.S. Application Data

(60) Provisional application No. 60/234,668, filed on Sep. 22, 2000.

(51) Int. Cl.[7] ..... A45D 42/00
(52) U.S. Cl. ..... 132/312; 132/316
(58) Field of Search ..... 132/291, 296, 132/301, 304, 316, 312; 359/871, 872, 879

(56) References Cited

U.S. PATENT DOCUMENTS 1,692,300 A * 11/1928 Heitel et al.
1,730,555 A * 10/1929 Brennan
2,461,421 A * 2/1949 Jacobus
2,526,596 A * 10/1950 Williamson

* cited by examiner

*Primary Examiner*—Todd E. Manahan
(74) *Attorney, Agent, or Firm*—Banner & Witcoff, Ltd.

(57) ABSTRACT

A vanity case includes a mirror positioned on a center section, the mirror being pivotal between a storage position and a use position and further includes side panels which fold over the mirror in the storage position.

8 Claims, 1 Drawing Sheet

PORTABLE VANITY CASE

CROSS REFERENCE TO RELATED APPLICATION

This application claims the priority benefit of provisional application Serial. No. 60/234,668 filed Sep. 22, 2000 for a Portable Vanity Case for which priority is claimed.

BACKGROUND OF THE INVENTION

In a principal aspect the present invention relates to a vanity case which includes a mirror and pockets for cosmetics, and the like.

When traveling, it is often desirable to have an easily accessible lightweight, nonbulky makeup or vanity case that can be used in combination with a mirror. Additionally, such a vanity case should be highly portable, and provide means for protecting the mirror when not in use. Further, such a vanity case should include storage capacity for cosmetics and other items and provide a means whereby the various items will be protected. Additionally, it is desirable that such a vanity case be foldable into a flat, compact arrangement whereby it can be included in an outer pocket, for example, of carryon luggage, or carried separately as a purse or ancillary to a purse.

SUMMARY OF THE INVENTION

Briefly, the present invention comprises a portable vanity case which includes a center or base section with a protective, supporting cushion ribs at the top and bottom of the base section. A mirror with support straps is provided on the base section. The support straps limit the pivotal movement of the mirror to its erect position. Elastic straps hold the mirror in the erect position. The mirror may also be folded flat into the case base section and side pockets then folded over the mirror to protect the mirror.

Thus it is an object of the invention to provide an improved portable mirrored vanity case.

It is a further object of the invention to provide a portable mirrored vanity case wherein the mirror may be folded into a protected position within the interior of the case.

Another object of the invention is to provide a mirrored vanity case wherein the mirror may be pivoted between a position for use and a storage position.

Another object of the invention is to provide a mirrored vanity case which maintains the mirror in a stored position in a flat case protected from breakage.

Yet another object of the invention is to provide an inexpensive yet highly portable, transportable and easily usable portable mirrored vanity case.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
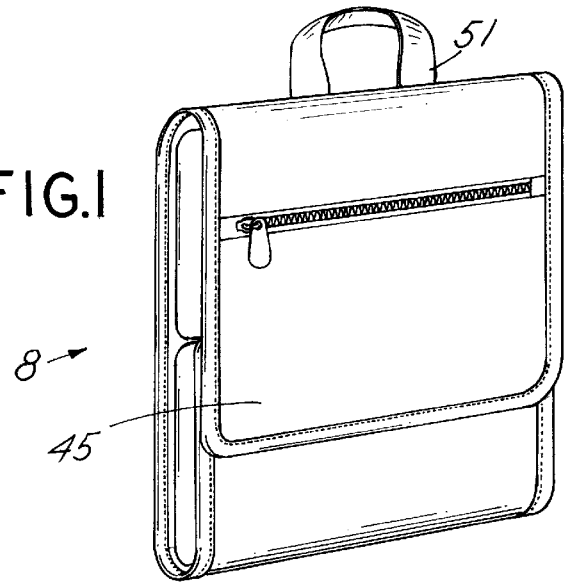
FIG. 1 is an isometric view of the vanity case wherein the case is in the folded or travel position.
Figure 2:
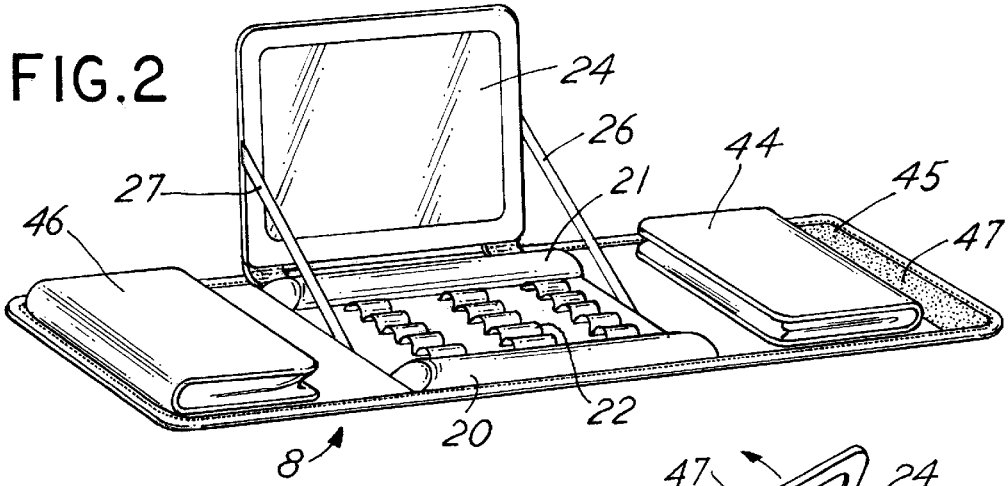
FIG. 2 is an isometric view of the case of FIG. 1 wherein the mirror has been opened and unfolded.

The subject matter of the invention relates to a portable vanity case or a case which may be used for travel as a cosmetic travel case and which includes a mirror for use when applying cosmetics. Referring to the drawing, case 8 includes a generally rectangular base, or base section 10, having a top edge 12, a parallel bottom edge 14, a first side edge 16 and a spaced, generally parallel, second side edge 18 defining the rectangular shape of the base 10. The base 10 includes a protective cushion rim or rib 20 along its lower bottom or edge 14 and a parallel cushion rib or rim 21 along top edge 12. Cosmetic storage loops 22 are provided on the inside surface of the base 10 between cushion ribs 20 and 21.

Figure 3:
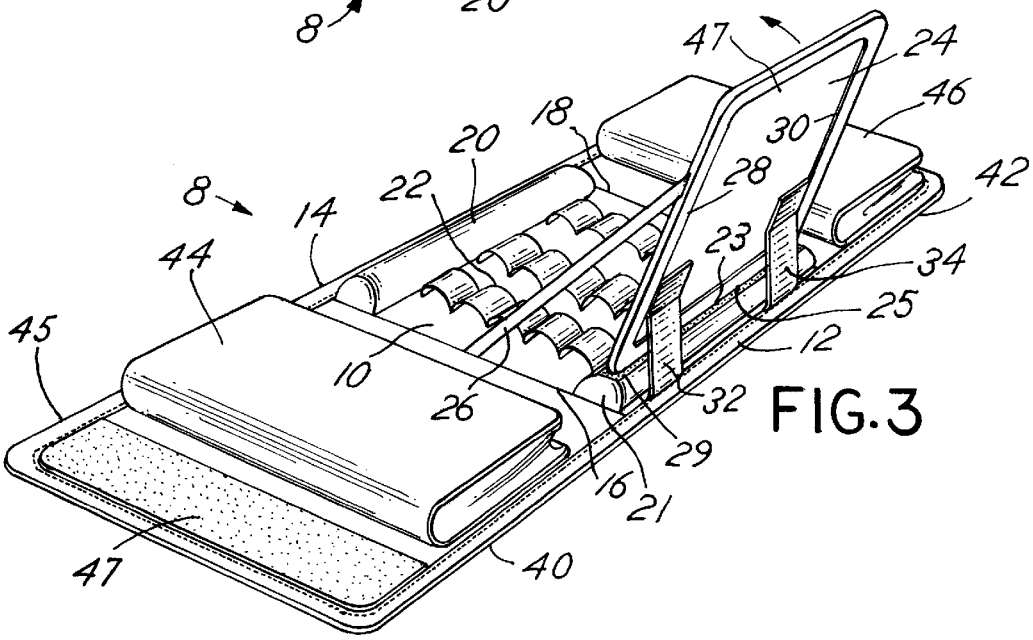
FIG. 3 is an isometric view of the case of FIG. 2 as viewed from the backside thereof.

Positioned along the top edge 12 of the base 10 is a mirror 24. In the embodiment shown, the mirror 24 is generally rectangular and includes a lower edge 23 which includes a hook and loop fastening strip 25 cooperative with a hook and loop strip 29 along the top or ridge of rib 21. Thus the mirror 24 may be pivotally attached to the base 10 or the mirror 24 may be detached from the strip 29 and pivoted in the direction depicted by the arrow in the FIG. 3 to a closed or stored position from the erect or use position illustrated in the figure. A strap 26 is affixed between the side edge 16 of base 10 and a side edge 28 of mirror 24. A similar strap 27 connects between the side edge 18 and opposite side edge 30 of mirror 24. One or two straps 26 may be utilized to control the pivot extent or upper erect position of the mirror 24 or base 10.

Attached between the top edge 12 of the base 10 and the backside of the mirror 24 are elastic straps 32 and 34. The elastic straps 32, 34 are attached to the mirror 24 so that they effect movement from the retraced position to the erect position depicted in the figure. The pivotal motion of the mirror is limited by the straps 26, 27.

Preferably, and importantly, the lower edge 26 of the mirror 24 and loop strip 29 are positioned parallel to and spaced slightly from the upper edge 12 to which the elastic straps 32 and 34 are attached as depicted in the figures. This enables the straps 32 and 34 to act more effectively in moving the mirror 24 to the erect position.

In the preferred embodiment, side panels 40 and 42 are flexibly attached, respectively, to side edges 16 and 18 of the base 10. The side panels 40, 42 each include a case or pocket 44, 46 respectively, The pockets 44 and 46 are for storage of cosmetic materials, for example. The panels 40 and 42 may be folded over the base 10 and fastened together to retain the mirror 24 in its storage position against cushion 22 as shown in FIG. 1. The pockets 44 and 46 have padded faces so as to further cushion the mirror 24. Thus, the cushioned pockets 44 and 46, as well as the cushion material, 20, 21 provide protection of the mirror 24 in the folded position.

It should be noted that the pockets 44 and 46 may fold entirely over the base or may fit partially over the base 10 with each panel 40 and 42 covering one half or a fraction of the mirror 24 and with one pocket including a flap or extension 45 with a fastener 47 (e.g., loop and hook) which engages a fastener on the outside of the pocket 46 as shown in FIG. 1. Also, a fastener strap (not shown) may be provided to hold the panels 40, 42 in the enclosed or folded position. Finally, a support strap or handle 51 may be attached to the outside of the case as shown in FIG. 1.

The number of straps 32 and 34 and their physical connection and arrangement with respect to the mirror 24 may be modified without departing from the spirit and scope of the invention. Thus, the invention is limited only by the following claims and equivalents thereof.

What is claimed is:

1. A portable vanity case comprising, in combination:

a base support panel having a generally rectangular shape with a top edge, a bottom edge and opposite side edges;

a mirror pivotally mounted spaced from and along the top edge of the base, said mirror pivotal between an erect position extending upwardly from the base and a retracted position resting on the base;

a holding strap between the mirror and the base for limiting the pivotal movement toward the erect position; and an elastic strap between the mirror and the base for biasing the mirror to the erect position.

2. The case of claim 1 including a protective rib along the bottom edge of the base.

3. The case of claim 2 wherein the side panel includes cosmetic storage pockets.

4. The case of claim 1 including cushion material on the base opposed to a mirror folded against the base.

5. The case of claim 1 including first and second side panels foldable over the base and mirror.

6. The case of claim 1 including at least one side panel attached to a side of the base and foldable over the mirror and base.

7. The case of claim 1 including a second elastic strap connecting the mirror to the base.

8. The case of claim 1 wherein storage loops are provided on the base of the inside of the case.

* * * * *